United States Patent [19]

Eberhard et al.

[11] Patent Number: 4,942,596

[45] Date of Patent: Jul. 17, 1990

[54] ADAPTIVE ENHANCEMENT OF X-RAY IMAGES

[75] Inventors: Jeffrey W. Eberhard, Schenectady; Rudolph A.A. Koegl, Niskayuna; John P. Keaveney, Schenectady, all of N.Y.

[73] Assignee: General Electric Company, Schenectady, N.Y.

[21] Appl. No.: 238,806

[22] Filed: Aug. 31, 1988

[51] Int. Cl.[5] ..... H05G 1/34

[52] U.S. Cl. ..... 378/109; 378/110; 378/112

[58] Field of Search ..... 378/108–112, 378/8, 16

[56] References Cited

U.S. PATENT DOCUMENTS 4,309,614 1/1982 Wagner ..... 378/108

4,773,087 9/1988 Pleaves ..... 378/108

*Primary Examiner*—Carolyn E. Fields

*Assistant Examiner*—David P. Porta

*Attorney, Agent, or Firm*—James C. Davis, Jr.; Paul R. Webb, II

[57] ABSTRACT

The quality of x-ray images is significantly enhanced by adjusting the x-ray system operating parameters in real time during acquisition of x-ray data to take information about the part into account adaptively. X-ray energy, x-ray flux, and integration time can all by varied independently and in combination to improve the signal to noise ratio in the image. The x-ray data from a previous subsection of the image is processed to determine optimum system operating parameters for a next image subsection. x-ray tube voltage is adjusted to change x-ray energy and keep $\alpha L$ close to 2 over all image subsections. X-ray tube current is adjusted to change x-ray flux and data acquisition integration time is adjusted to keep the signal to noise ratio within limits.

14 Claims, 6 Drawing Sheets

ADAPTIVE ENHANCEMENT OF X-RAY IMAGES

BACKGROUND OF THE INVENTION

This invention relates to a method of improving the quality of x-ray images by adjusting the x-ray imaging system operating parameters during data acquisition.

Real industrial parts have rather complex shapes. This causes difficulty in choosing one set of x-ray inspection parameters which is appropriate for the entire part.

The x-ray absorption in a material of linear attenuation coefficient $\alpha$ and thickness L is given by $$N_1 = N_o \exp(-\alpha L) \quad (1)$$

where $N_o$ is the number of x-rays incident on the part and $N_1$ is the number which penetrate it. If photon statistics are the dominant noise source, as they are in most cases for a well designed system, the signal to noise ratio in a digital radiography image is given by $$\frac{S}{N} = \alpha L \sqrt{N_o} \exp(-\alpha L/2) \quad (2)$$

Based on this expression, it is simple to show that the optimum signal to noise ratio for inspection is achieved when $\alpha L = 2$. The x-ray attenuation coefficient $\alpha$ depends on x-ray energy, so it can be varied to improve the inspection signal to noise ratio. The counting noise in the image is proportional to the square root of the number of x-rays detected, so signal to noise at a particular value of $\alpha L$ can be improved by increasing the number of x-rays available for the measurement. This can be achieved either by increasing the x-ray tube current, i, or the measurement time $\tau$, or both since $N_1$ is proportional to $i \times \tau$. However, neither parameter can be increased without limit, since increased tube current causes increased heat transfer to the tube anode and eventual failure, and increased measurement time can cause failure to meet throughput requirements.

Since industrial parts can have widely varying thicknesses and can be made of materials with different x-ray absorptivities, it is clear that no single choice of inspection energy or integration time and tube current will be optimum for all sections of a complex part. Therefore, image quality is degraded over most of each image. Current x-ray inspection systems simply determine the best x-ray energy and data acquisition integration time for the part as a whole before the scan is started. For film inspection there is no real alternative to this approach. The entire 2-D image data set is acquired simultaneously and no adjustment is possible. However, often several images of the same part are taken at different energies or different integration times in order to provide useful information about different regions. This process is slow and difficult to interpret, however, since the images of different regions are separate pieces of film, and transition regions may not be imaged clearly in any shot.

SUMMARY OF THE INVENTION

An object of this invention is to provide significantly improved image quality by adjusting x-ray imaging system parameters during the inspection to provide near optimum values everywhere in the part.

Another object is to provide for adaptive selection of optimum x-ray system operating parameters based on a previously acquired image of a line or other subsection of the part.

According to one aspect of the invention, a method of adaptively enhancing the quality of x-ray images comprises acquiring measured x-ray data for a subsection of an image of a part, and determining a signal to noise parameter of the measured data, such as a value of $\alpha L$ or the signal to noise ratio, and comparing the value to predetermined acceptable limits. One or more of the system operating parameters, such as x-ray energy, x-ray flux, and data acquisition integration time, for a next subsection of the image is adjusted to bring the signal to noise parameter within limits. X-ray data is acquired in sequence for other image subsections while alternately adaptively selecting the system operating parameters to improve image quality. The determining step may comprise calculating the signal to noise parameter of the previous image subsection, or averaging the parameters of a plurality of previous image subsections. When the x-ray detector is an array, a value of the signal to noise parameter is calculated for every array element and averaged.

One adjustment method is to determine the value of $\alpha L$ for measured data for an image subsection, and reset the x-ray energy by adjusting x-ray tube voltage such that $\alpha L$ is closer to 2 for the next image subsection. A second method is to determine the signal to noise ratio of the measured data for a subsection and compare the ratio to acceptable limits. The x-ray flux is reset by changing x-ray tube current so that the signal to noise ratio of a next image subsection is within the limits. A third method, after determining a signal to noise ratio and comparing to the limits, resets data acquisition integration time by adjusting the time a data acquisition system has to collect data from the x-ray detector such that the next image subsection signal to noise ratio is within limits.

A feature of the invention is that the three techniques of improving image quality may be employed independently or in combination. Having adjusted x-ray tube voltage to its upper limit, further signal to noise improvement is attained by adjusting x-ray tube current or data acquisition integration time. When tube current is at its upper limit, image quality is improved by going to the other techniques, and the same holds for data acquisition integration time if the time is so long that throughput requirements are not met.

DETAILED DESCRIPTION OF THE INVENTION

Figure 1:
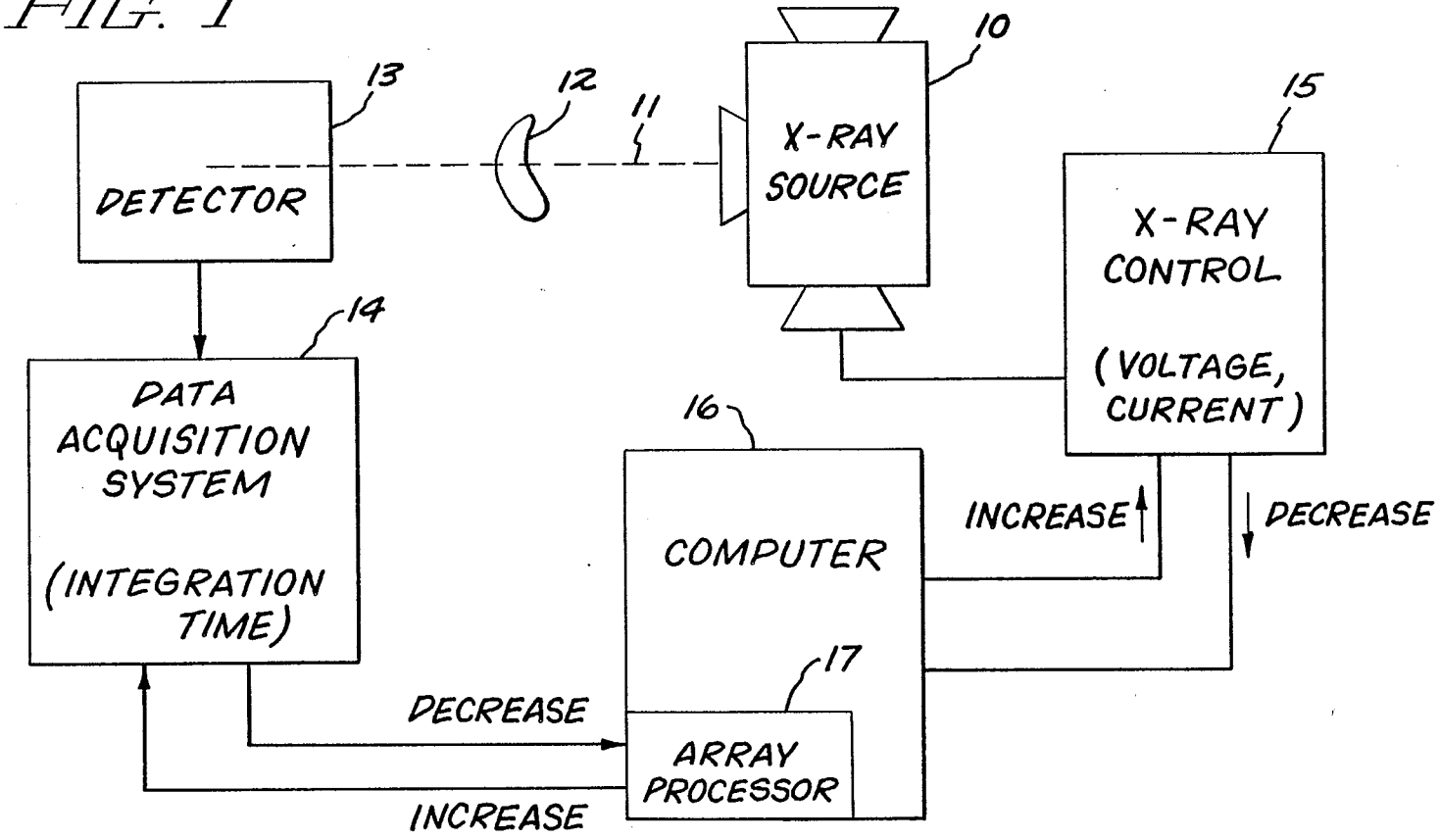
FIG. 1 is a block diagram of an x-ray imaging system which has an adaptive control to adjust system operating parameters and improve image quality.
Figure 2:
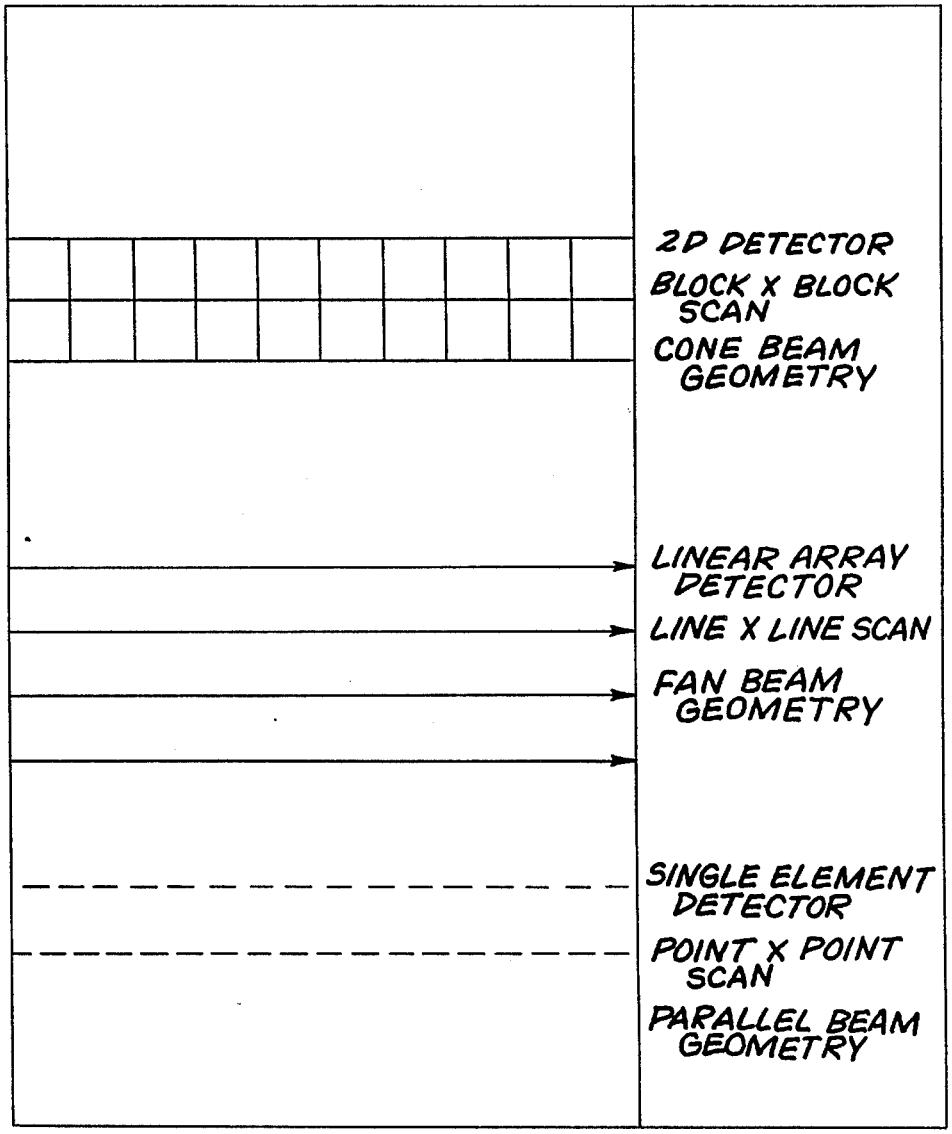
FIG. 2 shows diagrammatically the scan patterns or a 2D detector, a linear array detector, and a single element detector.

Referring to FIGS. 1 and 2, an x-ray inspection system is comprised of a conventional x-ray source 10 that generates an x-ray beam 11 which passes through a part 12 being inspected, such as an air foil. The beam 11 after passage through the part 12 is detected by an x-ray detector 13, and measured x-ray data is presented to a data acquisition system 14. Detector 13 may be a linear array, a 2D detector, or a single element detector to respectively detect a fan beam, a cone beam, and a parallel beam. X-ray data for the entire image is not taken simultaneously; rather x-ray data for subsections of the image are taken sequentially. Suppose, for example, that the inspection is to be carried out with a linear array detector in a digital x-ray inspection system. Data from the part is acquired one horizontal line at a time; the part is moved after each exposure. A two-dimensional image is created from these lines using an image reconstruction technique, either digital fluoroscopy or computed tomography. A two-dimensional detector array is associated with a block by block scan and acquires data for a rectangular or square subsection of the image. In parallel beam scanning where there is a single detector element, a line of the image is scanned point by point, then a second line is scanned and so on.

An x-ray control 15 adjusts the x-ray source voltage and current, either increasing or decreasing these operating parameters upon command from a computer 16. Changing the x-ray source voltage varies the x-ray inspection energy, and adjusting the x-ray source current increases and decreases the x-ray flux. Measured x-ray data is passed from the data acquisition system 14 to an array processor 17 which may be part of computer 16. Upon command from the computer the data acquisition integration time is decreased and increased. Integration time is the time to acquire x-ray data from one subsection of the image; it is the data acquisition time for one subsection.

The current invention is to process the measured x-ray data from one subsection of the image and to adjust the operating parameters of the x-ray imaging system in real time, so that the operating parameters are optimized for the next image subsection based on the values of the previous subsection. Before display, the data is normalized to provide an image of a single parameter for all subsections of the image.

One method of enhancing the quality of x-ray images is to select the x-ray energy adaptively during inspection of the part to provide the best signal to noise possible in each segment and subsection of the image. For an x-ray imaging system with a linear array detector, an image subsection is one line of data. A value of $\alpha L$ for each detector element can be determined very quickly with the array processor 17 during data acquisition, and the values are averaged to get an average value of $\alpha L$ for the image subsection. The x-ray energy is reset by computer 16 so that $\alpha L$ is closer to 2 for the next scan line. Computer 16 commands the x-ray control 15 to either increase or decrease the x-ray source voltage. This process continues line by line throughout image formation. Each line of the image has then been optimized for the best signal to noise ratio based on the average value of $\alpha L$ in the previous line. Other techniques for determining the appropriate x-ray energy for the next image subsection, such as averaging over several previous image subsections, with or without a weighting factor, are clearly within the scope of the invention. A similar approach is taken to setting the x-ray energy for each view in a computerized tomography image.

Figure 3:
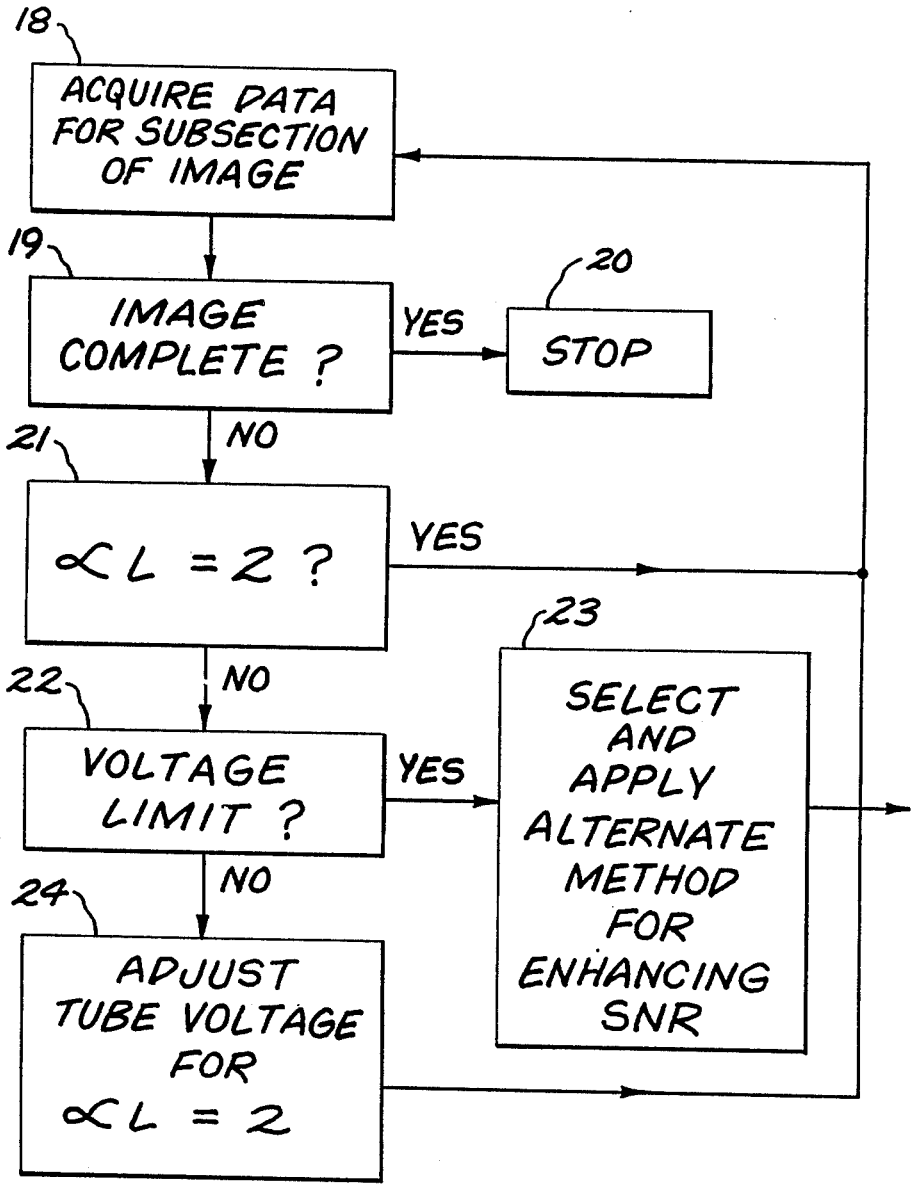
FIG. 3 is a flowchart illustrating the tube voltage or x-ray energy adjustment method.

The tube voltage and x-ray energy adjustment method is given in more detail in the operational block diagram in FIG. 3. Steps 18–20 show that measured x-ray data is acquired for one subsection of the image, and if the image is complete the process stops. Otherwise, step 21, the value of $\alpha L$ is computed for that image subsection measured data and when approximately equal to 2 no adjustment of x-ray energy is called for and data acquisition for the next image subsection proceeds. If not equal to 2, steps 22 and 23, a test is first made if the tube voltage is at its upper limit, and in this case an alternate method for enhancing the signal to noise ratio is selected and applied. The peak energy of x-ray tubes can only be adjusted over a certain range, for example, 230 KeV to 420 KeV for one tube. If below the limit, step 24, the tube voltage is adjusted such that $\alpha L$ is closer to 2 for the next image subsection.

One method of determining $\alpha L$ and the new tube voltage is as follows. It was shown in equation (1) that $$\log \frac{N_1}{N_o} = -\alpha L \tag{3}$$

at every detector element of a linear array. $N_o$, the number of x-rays incident on the part, is measured without the part in place; then the part is put in and $N_1$, the number of x-rays which penetrate through the part, is measured. The value of $\alpha L$ at each element is calculated, and an average $\alpha L$ for all the array elements and the image subsection. Suppose that the average $\alpha L$ is 1.5. The assumption is made that L from one image subsection to the next does not change and all the variation will be in $\alpha$. Then the new $\alpha$ will be larger than the previous $\alpha$ by the ratio 2/1.5. There are tables that have in two columns the values of $\alpha$ and the corresponding x-ray energy. Having the new $\alpha$, the x-ray energy (in KeV) is read out and the tube voltage (in KV) is set accordingly. A refinement on this technique is to factor in the change in L from one image subsection to the next if, say, the blueprints of the part are available and L at the next image subsection is known.

Another aspect of the invention is to improve the signal to noise ratio in the image by increasing the number of x-rays available for the measurement in an optimum manner consistent with the available inspection time. This can be done by changing either the data acquisition integration time per image subsection or the tube current. The base line integration time per subsection and tube current are chosen based on the required signal to noise ratio to detect flaws of interest and on throughput requirements. These values can be adjusted and modified in the course of a data acquisition run to maintain signal to noise ratio values over a range of part thicknesses.

For a standard industrial x-ray tube, it may be advantageous to set the current at the maximum value consistent with power limitations and therefore achieve the fastest possible scan. For a microfocus tube, however, where tube current strongly affects filament life, adaptive control and hence lower current over sections of the part scan are a significant advantage. In general, maximum throughput is a significant advantage, so the ability to increase data acquisition integration time only over sections of the part where required is important.

Figure 4:
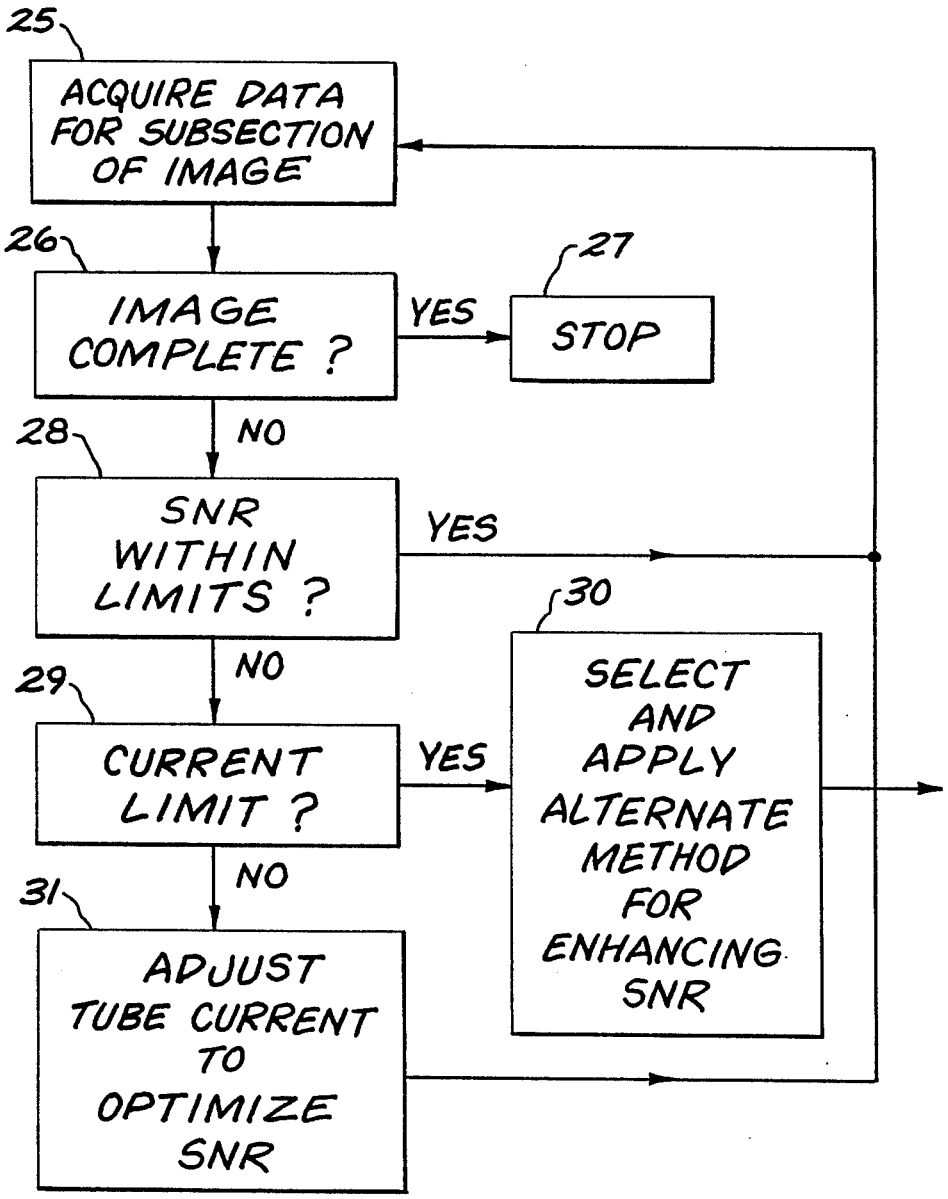
FIG. 4 is a flowchart illustrating the tube current or x-ray flux adjustment method.

The tube current and x-ray flux adjustment method of enhancing image quality is outlined in FIG. 4. Initial steps 25–27 are the same; x-ray data is acquired for an image subsection and a check is made that the image is not complete. The signal to noise ratio of the image subsection x-ray data, step 28, is computed and compared to a prechosen acceptable range, for instance, 80:1 to 120:1. A signal to noise ratio higher than this could require such a high current as to burn out the tube. In steps 29–31, before adjusting tube current to optimize the signal to noise ratio, a check is first made that the tube current is not above its upper limit, in which case it will be necessary to select and apply an alternate method for enhancing the signal to noise ratio. Tube current may be either increased or decreased when the ratio is respectively worse than the lower limit or too high There are many ways of calculating the signal to noise ratio of a block of measured data. A standard procedure where N measurements have been made is to divide the mean value of the N measurements by the standard deviation. It is advantageous to calculate the signal to noise ratio using equation (2) since $\alpha L$ is known as is $N_o$.

Figure 5:
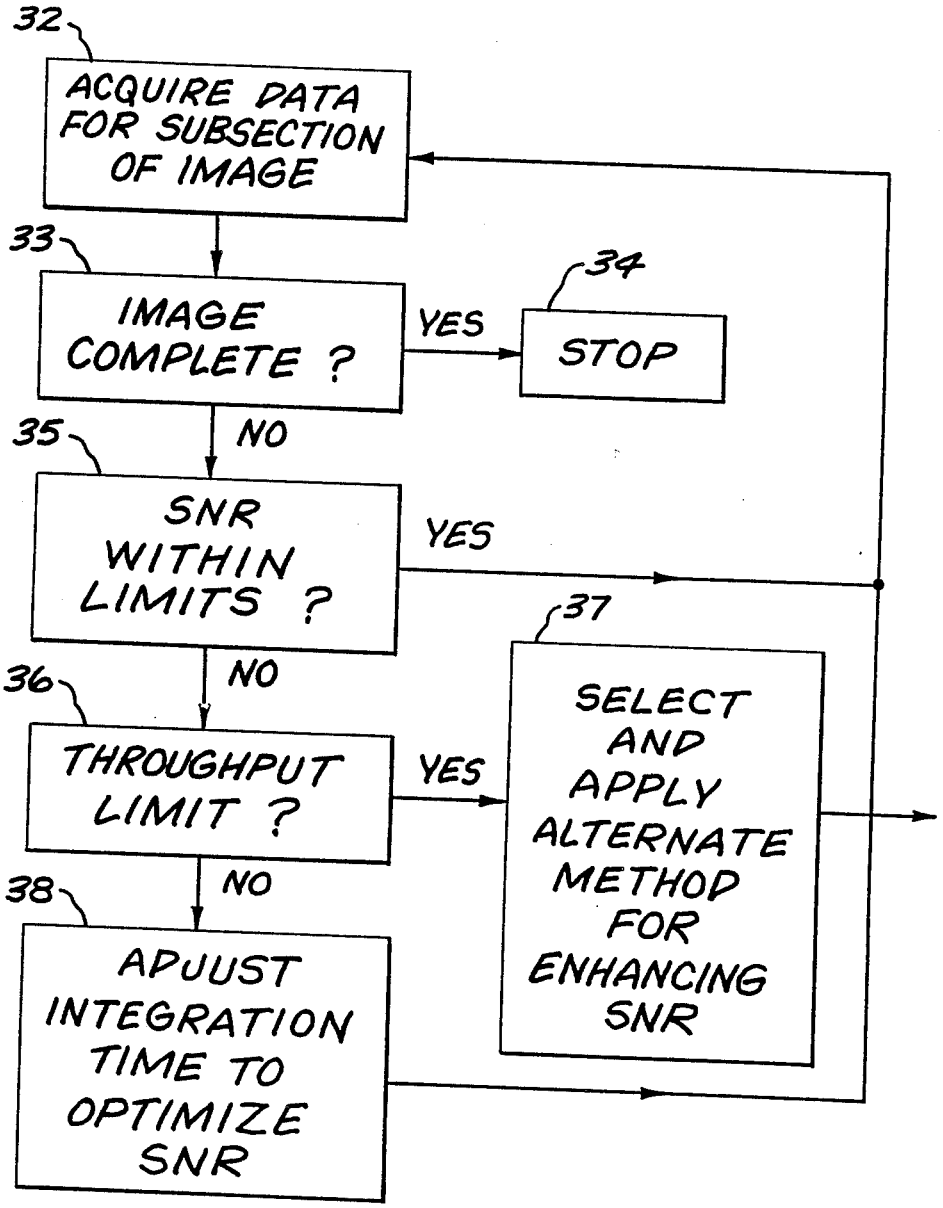
FIG. 5 is a flowchart illustrating the integration time adjustment method.

The integration time adjustment method to improve image quality in real time is illustrated in FIG. 5. Steps 32–35 are the same as already described. At steps 36 and 37, a throughput limit test is made to determine whether the data acquisition integration time is so low that throughput requirements are not met. When this occurs an alternate method for enhancing the signal to noise ratio is selected and applied. If not already too low, step 38, the integration time is adjusted to bring the signal to noise ratio within the prechosen acceptable limits and optimize it.

Figure 6:
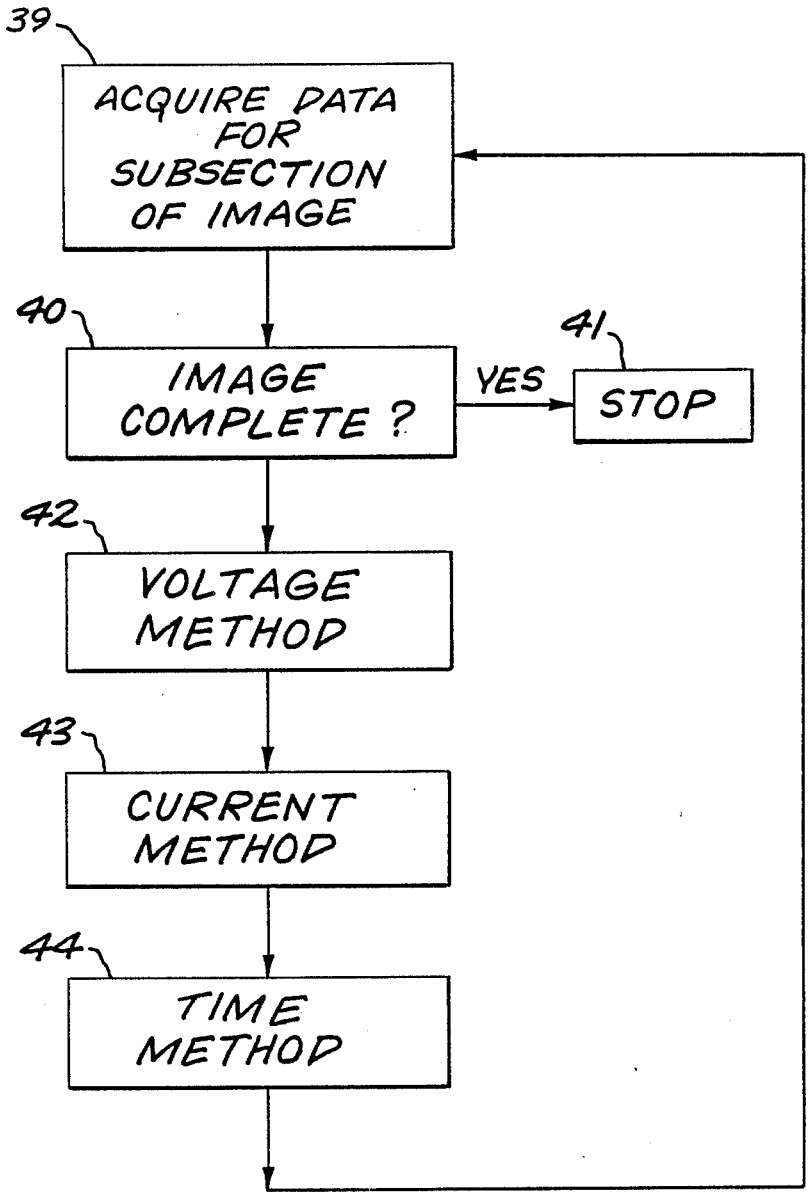
FIG. 6 is an operation block diagram showing one sequence of implementing the three methods.

One sequence of implementing the three image enhancement methods is given in FIG. 6. Referring to blocks 39–44, after acquiring measured x-ray data for one sub-section of the image, and determining that the image is incomplete, the tube voltage is adjusted until the upper voltage limit of the x-ray tube is reached. Then the tube current is adjusted until the upper current limit is reached, and thereafter the integration time is increased to obtain further improvement in the signal to noise ratio. Other sequences of the voltage, current, and time methods are possible.

Consider a typical example that may arise during part inspection. Suppose, for example, that the current image subsection is a line in a region of moderate thickness and the x-ray energy has been chosen so that $\alpha L=2$, and that the part is increasing in thickness as the scan proceeds. X-ray energy will be adjusted upwards line by line as the thickness increases to maintain $\alpha L=2$. However, peak energy of the tube can only be adjusted over a certain range. When the peak energy is at the upper limit of this range, no further adjustment is possible. Then, however, adjustment of x-ray tube current allows maintenance of the same signal to noise ratio over an additional region of part thickness. When tube current has been increased to its upper limit, the data acquisition integration time is adjusted. The amount of improvement in image quality which can be achieved using these techniques is significant. In the energy range from 200 to 400 KeV, improvements on the order of 40–80% can be achieved by adjusting tube voltage during the course of a run. By doubling either integration time or tube current, improvement of roughly 40% can be achieved. Those improvements can provide substantially increased flaw detection capability in real imaging applications.

The invention is useful for x-ray imaging any part with rapidly changing shapes or x-ray absorptivity. It is particularly advantageous for large complex parts where x-ray penetration is a problem since it allows critical inspection time to be used in regions where improvement is greatest, and rapid inspection in regions where data quality is already high. It is also useful in very high resolution imaging where microfocus tubes must be used, because of the severe tube current and anode life restrictions in these systems. The image enhancement methods of this invention may be used in systems with other x-ray sources such as a linear accelerator.

While the invention has been particularly shown and described with reference to preferred embodiments thereof, it will be understood by those skilled in the art that the foregoing and other changes in form and details may be made without departing from the spirit and scope of the invention as defined in the appended claims.

What is claimed is:

1. A method of adaptively enhancing the quality of x-ray images produced by an x-ray imaging system having a plurality of system operating parameters that are adjustable, comprising:

acquiring measured x-ray data for a subsection of an image of a part;

determining a signal to noise parameter of said measured data and comparing to predetermined acceptable limits;

adjusting one or more of said system operating parameters for a next subsection of said image to bring said signal to noise parameter within limits;

acquiring measured x-ray data in sequence for other image subsections while alternately adaptively selecting said system operating parameters to improve image quality; and normalizing said acquired data to provide a single parameter for all subsections of said image.

2. The method of claim 1 wherein said signal to noise parameter is $\alpha L$, where $\alpha$=linear attenuation coefficient and L=part thickness, and x-ray energy is one system operating parameter that is adaptively adjusted so that $\alpha L$ is approximately 2 over all of said image subsections.

3. The method of claim 1 wherein said signal to noise parameter is the ratio thereof and x-ray flux is one system operating parameter that is adaptively adjusted so that the signal to noise ratio is between said limits over all of said image subsections.

4. The method of claim 1 wherein said signal to noise parameter is the ratio thereof and x-ray data acquisition integration time is one system operating parameter that is adaptively adjusted so that the signal to noise ratio is between said limits over all of said image subsections.

5. The method of claim 1 wherein said determining comprises averaging the signal to noise parameter of a plurality of previous image subsections.

6. A method to adaptively enhance the quality of x-ray images produced by an x-ray imaging system having system operating parameters that are adjustable to change x-ray energy, x-ray flux, and data acquisition integration time, comprising:

acquiring measured x-ray data for a first subsection of an image of a part;

determining a value of $\alpha L$ for said first subsection measured data, where $\alpha$=linear attenuation coefficient and L=part thickness;

resetting said x-ray energy by changing x-ray tube voltage such that $\alpha L$ is closer to 2 for a next subsection of said image;

acquiring measured x-ray data in sequence for other image subsections while alternately adaptively adjusting said x-ray tube voltage as needed to improve image quality by having $\alpha L$ close to 2 over all of said image subsections; and normalizing said acquired data to provide a single parameter for all subsections of said image.

7. The method of claim 6 wherein said imaging system has an x-ray detector array and said determining comprises determining a value of $\alpha L$ for every element of said array and averaging.

8. The method of claim 6 further comprising adjusting said x-ray flux to improve image quality after x-ray tube voltage has been adjusted to its upper limit.

9. The method of claim 6 further comprising adjusting said data acquisition integration time to improve image quality after x-ray tube voltage has been adjusted to its upper limit.

10. The method of claim 6 wherein said determining comprises averaging the value of $\alpha L$ for a plurality of previous image subsections.

11. A method to adaptively enhance the quality of x-ray images produced by an x-ray imaging system having system operating parameters that are adjustable to change x-ray energy, x-ray flux, and data acquisition integration time, comprising:

acquiring measured x-ray data for a first subsection of an image of a part;

determining a signal to noise ratio of said first subsection measured data and comparing to prechosen acceptable limits;

resetting said x-ray flux by changing x-ray tube current such that the signal to noise ratio of a next subsection of said image will be within said limits;

acquiring measured x-ray data in sequence for other image subsections while alternately adaptively adjusting said x-ray tube current; and normalizing said acquired data to provide a single parameter for all subsections of said image.

12. The method of claim 11 further comprising proceeding to another technique of changing said signal to noise ratio by adjusting at least one of said x-ray energy and data acquisition integration time after said x-ray tube current has been adjusted to its upper limit.

13. A method to adaptively enhance the quality of x-ray images produced by an x-ray imaging system having system operating parameters that are adjustable to change x-ray energy, x-ray flux, and data acquisition integration time, comprising:

acquiring measured x-ray data for a first subsection of an image of a part;

determining a signal to noise ratio of said first subsection measured data and comparing to prechosen acceptable limits;

resetting data acquisition integration time by changing the time a data acquisition system collects data from an x-ray detector such that the signal to noise ratio of a next subsection of said image will be within said limits;

acquiring measured x-ray data in sequence for other image subsections while alternately adaptively adjusting said data acquisition integration time; and normalizing said acquired data to provide a single parameter for all subsections of said image.

14. The method of claim 13 further comprising proceeding to another technique of changing said signal to noise ratio by adjusting at least one of said x-ray energy and flux after said data acquisition integration time becomes too low to meet throughput requirements.

* * * * *